United States Patent [19]

Dikoff

[11] 3,952,649

[45] *Apr. 27, 1976

[54] CHECK PRINTER HAVING RIBBON CARTRIDGE

[76] Inventor: Joseph K. Dikoff, No. 4 Privateer, Apt. 3, Marina Del Rey, Calif. 90291

[ * ] Notice: The portion of the term of this patent subsequent to Aug. 13, 1991, has been disclaimed.

[22] Filed: Apr. 25, 1974

[21] Appl. No.: 463,961

[52] U.S. Cl. ..... 101/100; 101/45; 101/102; 101/336

[51] Int. Cl.[2] ..... B41J 17/32

[58] Field of Search ..... 101/19, 100, 20, 45, 101/56, 269, 274, 110, 102, 99, 95, 96, 287, 316, 318, 322, 336, 103; 197/151, 170

[56] References Cited

UNITED STATES PATENTS

| | | | |
|---|---|---|---|
| 2,026,115 | 12/1935 | Anthony | 101/274 |
| 2,110,797 | 3/1938 | Harris | 101/20 |
| 3,083,641 | 4/1963 | Childs et al. | 101/110 X |
| 3,296,959 | 1/1967 | Sewell | 101/316 X |
| 3,400,800 | 9/1968 | McMillan et al. | 101/336 X |
| 3,589,279 | 6/1971 | Deutsch | 101/336 X |
| 3,661,080 | 5/1972 | Laws | 101/269 |
| 3,757,688 | 9/1973 | Weber | 101/45 |
| 3,828,664 | 8/1974 | Dikoff | 101/110 X |

*Primary Examiner*—Edgar S. Burr
*Assistant Examiner*—Edward M. Coven
*Attorney, Agent, or Firm*—Fulwider, Patton, Rieber, Lee & Utecht

[57] ABSTRACT

A check printer and including a base having an upwardly facing check print surface thereon and a chassis disposed thereover, such chassis cooperating with the base to form a pathway leading from one side to the other of the check print surface. A plurality of printing wheels are mounted in side-by-side relationship from said chassis for disposition over the check print surface. An ink ribbon cartridge is mounted from the chassis and includes a flat frame overlying the print surface with ink ribbon rollers carried therefrom and disposed on opposite sides of such print surface. An actuating handle engages the chassis and is operable upon depression thereof to shift the chassis downwardly to engage the wheels with a check resting on the print surface to print the numbers selected on such individual wheels on such check.

7 Claims, 5 Drawing Figures

CHECK PRINTER HAVING RIBBON CARTRIDGE

BACKGROUND OF THE INVENTION

1. Field of the Invention

The check printer of the present invention relates to a device for printing checks in such a manner that subsequent alteration thereof without detection becomes extremely difficult.

2. Description of the Prior Art

Many efforts have been made to provide a low cost check printer which is convenient to use and inexpensive to maintain. However, most prior art check printers have a rather elaborate ink ribbon mounting arrangement which requires skilled personnel for replacement thereof thus substantially contributing to the cost of operating and maintaining the printer. There are no prior art check printers known to applicant which incorporate a ribbon cartridge that can be conveniently and rapidly replaced by unskilled office personnel.

SUMMARY OF THE INVENTION

The check printer of the present invention is characterized by a ribbon cartridge including a frame mounting ink ribbon rollers on opposite sides thereof and, itself, removeably attached to the chassis of the printer for convenient removal and replacement thereof.

The objects and advantages of the present invention will become apparent from a consideration of the following detailed description when taken in conjunction with the accompanying drawings.

DESCRIPTION OF THE SPECIFIC EMBODIMENT

Figure 2:
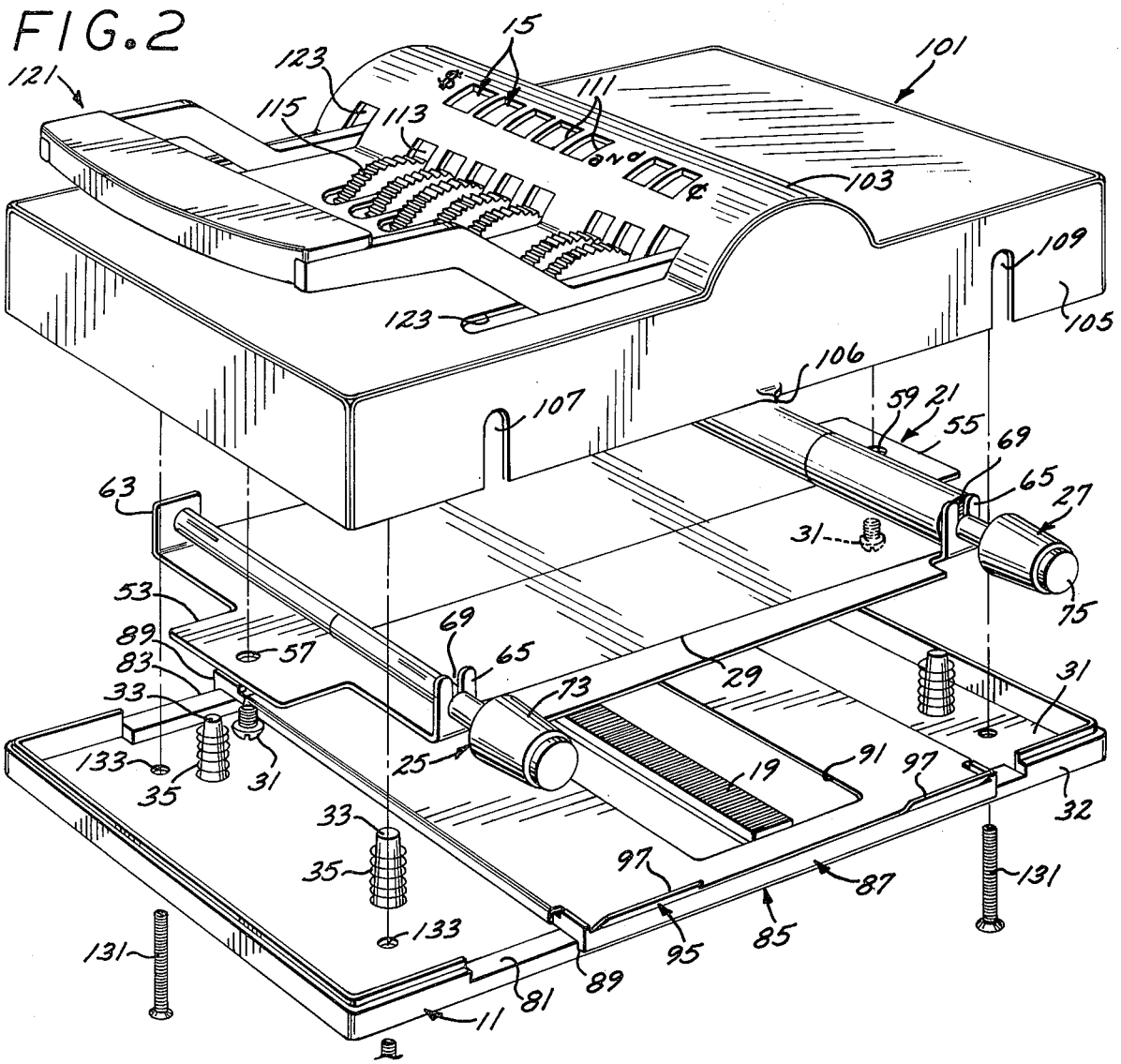
FIG. 2 is an exploded view similar to FIG. 1.
Figure 3:
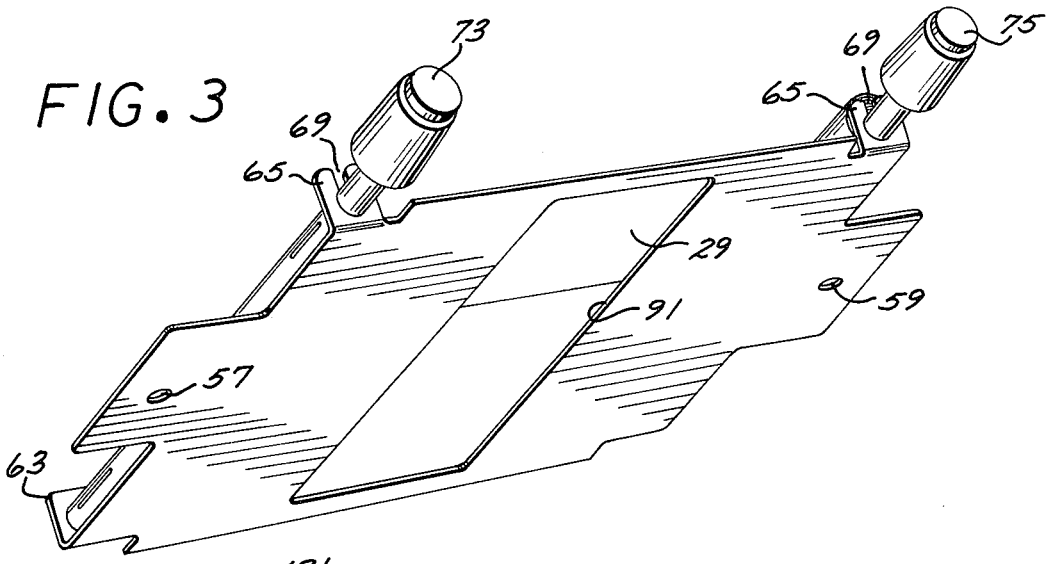
FIG. 3 is a perspective view of an ink ribbon cartridge included in the check printer shown in FIG. 1.

Referring to FIG. 2, the check printer of the present invention includes, generally, a base 11 having a floating chassis 13 (FIG. 4) mounted thereover and carrying a plurality of independently rotatable print wheels 15 thereon. The base 11 includes a serrated print surface 19 which has an ink ribbon cartridge frame, generally designated 21, disposed thereover, such cartridge frame being of generally flat construction and formed centrally with a printing wheel access window 23 (FIG. 5) and carrying ink ribbon rollers, generally designated 25 and 27, at the opposite ends thereof. Projecting between the rollers 25 and 27 and downwardly through the window 23 is an ink ribbon 29 having a downwardly facing ink impregnated surface. The cartridge frame 21 is removeably attached to the chassis 13 by means of screws 31 (FIG. 2) whereby such cartridge may conveniently be removed from the chassis 13 and replaced by a replacement cartridge having a fully charged ink ribbon 29 thereon.

The base 11 is horizontally disposed and formed with a bottom wall 31 having a peripheral border 32 formed therearound. Spaced about the bottom wall 31 are four upstanding somewhat conically shaped posts 33 having coil compression springs 35 telescoped downwardly thereover. The chassis 13 is formed with bosses 39 (FIG. 5) for receipt of the posts 33 and the springs 35 act upwardly against the bottom of such chassis to normally urge such chassis upwardly to its elevated position shown in FIG. 4.

Figure 4:
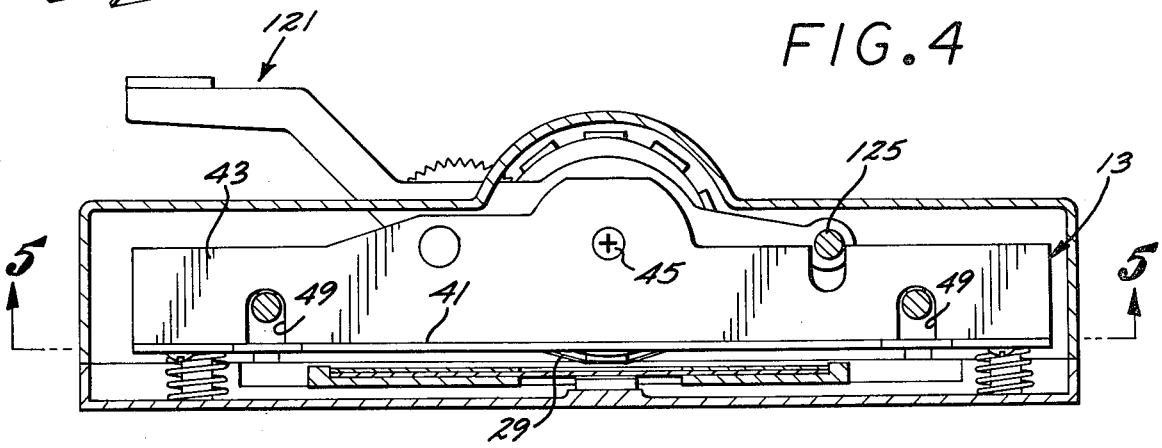
FIG. 4 is a longitudinal sectional view taken along the line 4—4 of FIG. 1.
Figure 5:
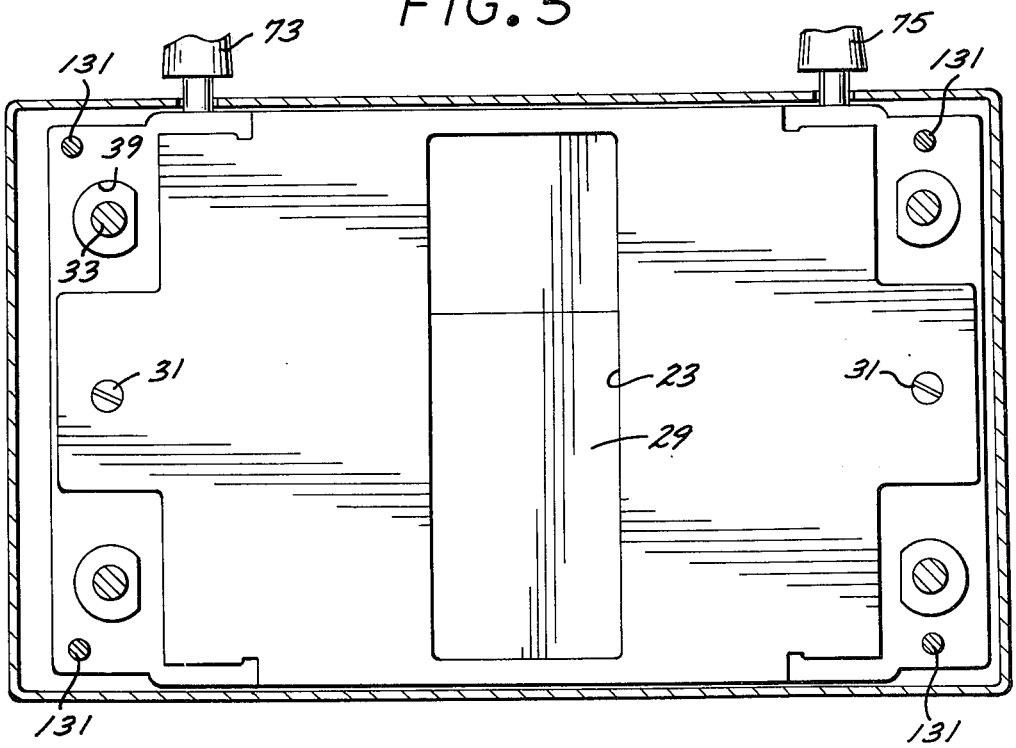
FIG. 5 is a horizontal sectional view taken along the line 5—5 of FIG. 4.

Referring to FIG. 4, the chassis 13 is formed with a horizontally extending bottom wall 41 having upstanding side and end walls 43 formed about the periphery thereof. A transverse shaft (not shown) is carried centrally from the chassis side walls 43 by means of mounting screws 45 and the printing wheels 15 are mounted on such shaft in side-by-side relationship for independent rotation thereof. The side walls 43 are formed at their opposite extremities with downwardly opening arches 49 for receipt of the ribbon rollers 25 and 27 whereby such cartridge may be reciprocated vertically with respect to such rollers.

The cartridge 21 is of flat plate-like construction and is formed at its opposite ends with axially projecting mounting tabs 53 and 55 having respective mounting bores 57 and 59 formed therein for receipt of the mounting screws 31. Such cartridge 21 is further formed at its opposite extremities with pairs of transversely aligned upstanding ears 63 and 65, the ears 63 being formed with bores for receipt of the respective one ends of the respective rollers 25 and 27 and the ears 65 being formed with upwardly opening slots 69 for receipt of the respective opposite ends of such rollers. The rollers 25 and 27 have respective turning knobs 73 and 75 mounted on the respective projecting one extremities thereof to enable rotation thereof to wind the ink ribbon 29 from one roller to the other.

Referring to FIGS. 2 and 4, the base border 32 is cut back intermediately along its opposite sides to form longitudinal slots, the bottom of which are defined by rails 81 and 83 (FIG. 2) upon which the opposite ends of a check tray, generally designated 85, rides, such check tray being interposed between the base 11 and ink ribbon cartridge 21. The check tray 85 includes a plate-like slider 87 formed at its opposite side extremities with downturned lips 89 which are received on the outsides of the rails 81 and 83 to guide forward and rearward sliding of such tray on the rails. The slider 87 is formed centrally with a window 91 overlying the check print surface 19. Received over the slider 87 is a check tray cover 95 formed centrally with a window 91 overlying the check print surface 19. The cover 95 is formed on one side with a pair of spaced apart, upwardly tapered flares 97 for guiding a check between such cover and the slider 87.

The base 11, chassis 13 and cartridge 21 are covered by a downwardly opening cover 101 which is of generally rectangular shape and formed centrally in its top wall with a transversely extending semi-cylindrical hump 103 for accommodating the upper extremities of the printing wheels 15. The cover 101 is opaque to conceal a check carried on the tray 85 from the operator and is formed about its periphery with a downwardly projecting skirt 105 which is received on the base border 32, such skirt being formed centrally in one side with an index pointer 106 aligned adjacent the printing wheels 15. The skirt 105 is formed on one side with longitudinally spaced apart downwardly opening slots 107 and 109 for accommodating the extremities of the respective ribbon rollers 25 and 27. The cover 101 is formed in the hump 103 with windows 111 for viewing indexing numbers carried on the print wheels 15, such indexing numbers being interposed between sequential raised printing numbers and disposed diametrically opposite the respective corresponding printing numbers.

Further, the top wall of cover 101 is formed with a row of side-by-side slots 113 disposed adjacent windows 111 for projection therethrough of the upper peripheries of respective courser wheels 115 which are formed in their peripheries with gear teeth which mesh with gear teeth formed adjacent and integral with convenient adjustment of such wheels to select the desired number array for such printing wheels.

Referring to FIGS. 2 and 4, a U-shaped handle, generally designated 121, is provided for depressing the chassis 13 and has its opposite legs projecting downwardly through elongated slots 123 formed in the top of the cover 101. Referring to FIG. 4, the ends of the arms of such handle 121 are pivotally connected to the opposite sides of the cover 101 by means of a transverse pivot rod 125 and the intermediate portion of such arms overlie the shaft (not shown) carrying the printing wheels 15 whereby depression of the free end of such handle depresses such shaft and, consequently, the chassis 13, to carry the wheels 15 downwardly into printing engagement with a check carried on the check tray 85.

Projecting downwardly from the top wall of the cover 101 in the respective four corners thereof are downwardly opening internally threaded bosses for receipt of respective fastening screws 131 (FIG. 2) which project through respective bores 133 in the base 11 to screw into such bosses to secure the cover 101 in position.

In operation, when it is desirable to print and serrate the numbers on a check for representing the amount of such check, the courser wheels 115 are rotated to rotate the print wheels 15 to align the respective desired selector numbers with the windows 15, thereby aligning the corresponding desired print numbers over the print surface 19 (FIG. 2) to ready such wheels for printing of the desired sum on the check.

Figure 1:
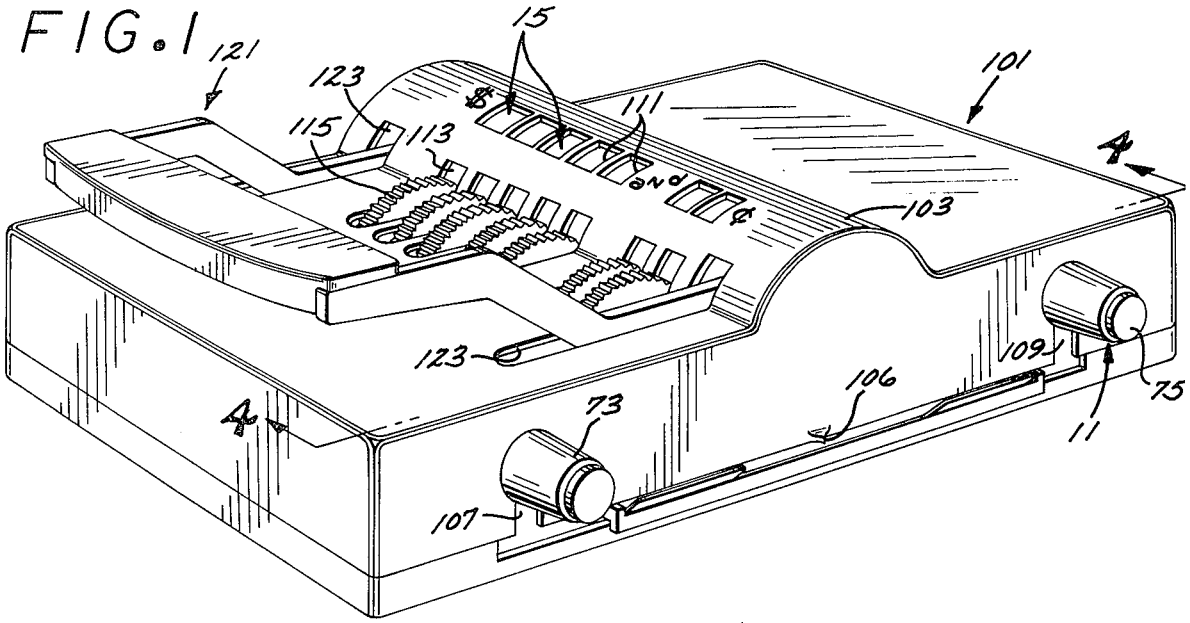
FIG. 1 is a perspective view of a check printer embodying the present invention.

The check is then inserted in the check tray 85 by projecting the leading end of such check beneath the flares 97 to slide between the cover 95 and the tray 87 to thereby align such check centrally with respect to the transverse dimension of the printer. The check tray 85 may then be shifted longitudinally with respect to the base 11 to align the print line on such check with the index pointer 106 (FIG. 1) thereby assuring that the index is properly aligned beneath the print wheels 15.

The free end of the handle 121 is then depressed to rotate such handle about the pivot rod 125 (FIG. 4) to rotate the intermediate portion of such handle downwardly, thereby pressing the shaft carrying the print wheels 15 downwardly to carry the chassis 13 downwardly against the bias of the coil springs 35. Downward movement of such print wheels 15 will carry the ink ribbon 29 downwardly against the check to urge such check downwardly against the serrated printing surface 19 to transfer ink from such ribbon onto the check while simultaneously serrating the printed numbers on such check to discourage the erasing of such ink without visible damage to the check. The free end of the handle 121 is then released and the coil springs 35 allowed to return the chassis 13 to its raised position and the check itself is ready for removal, signature and negotiation.

As printing of a number of checks is completed, the inked condition of the ribbon immediately beneath the print wheels 15 will deteriorate and the take-up knob 73 may be rotated to rotate the corresponding ink ribbon roller 25 to advance the ribbon 29 off the feed roller 27 to position a new length of ribbon beneath the print wheels 15. This procedure may be continued until the entire length of ribbon has been advanced off the feed roller 27, at which time the ink ribbon cartridge 21 is ready for replacement. However, should a replacement cartridge not be readily available, additional checks may still be printed by taking the used ribbon up on the roller 27, thus feeding the somewhat used, but still slightly ink-bearing, ribbon beneath the print wheels 15 for printing of additional checks.

When the cartridge 21 is to be replaced with a fresh cartridge, the operator need merely remove the four fastening screws 131, lift the cover 101 off the base 11, and pick the chassis 13 up off the posts 33. The operator may then rapidly remove the cartridge-fastening screws 31 and discard the cartridge 21. A new cartridge with a fully charged ink ribbon 29 may then be installed by placing such cartridge flush against the underside of the chassis 13 and re-inserting the screws 31. The chassis 13 may then be again mounted on the posts 33 and the cover 101 brought into position overlying the base 11 and the screws 131 again inserted. The check printer is then ready for use in printing additional checks.

From the foregoing, it will be apparent that the check printer of the present invention provides means for printing a check in such a manner that alteration of the sum printed on such check is rendered extremely difficult, thus discouraging unauthorized tampering with the subsequently signed check. Further, the ribbon cartridge incorporated therein is of relatively inexpensive construction and may be readily replaced by unskilled office personnel, thus avoiding recurring, relatively expensive maintenance fees.

Obviously, many modifications and variations of the present invention may be made with regard to the foregoing detailed description without departing from the spirit of the invention.

I claim:

1. A check printer comprising:

a horizontally projecting base;

a check support surface mounted on said base;

a chassis removably mounted on said base for movement toward and away from said support surface, said chassis being formed with a flat underside cooperating with said base to form a straight pathway leading from one side to the other of said check support surface and including ink ribbon cartridge mounting means;

a plurality of printing wheels disposed over said support surface and mounted on said base in side-by-side relationship for independent rotation thereof, said wheels being formed in their peripheries with printing members;

an ink ribbon cartridge including a flat plate underlying said flat underside and formed with a window overlying said check support surface for passage therethrough of the peripheries of said wheels and including two pairs of upturned ears formed on opposite ends thereof with the ears of said pairs being disposed at opposite sides of said plate, said ears including reel mounting means, said cartridge further including feed and take-up reels mounted on their opposite ends on said reel mounting means and an ink ribbon leading from said feed reel across said pathway to said take-up reel and advance means on said take-up reel for rotating said take-up reel to advance said ribbon;

fastening means for removably mounting said cartridge to said cartridge mounting means;

an actuating handle engaging said chassis for depression thereof to press the periphery of said wheels into engagement with said ribbon to, in turn, press it through said window and against a check on said check support surface; and a cover removably mounted on said base to cover said chassis whereby said take-up reel may be advanced incrementally to position fresh ribbon under said wheels and when the ink in said ribbon becomes depleted said cover and chassis may be removed, said fastening means unfastened and said cartridge removed as a unit and replaced with a replacement cartridge.

2. A check printer according to claim 1 wherein:

said cartridge mounting means includes a pair of threaded bores disposed at opposite ends thereof;

said cartridge includes a pair of screw-receiving bores aligned with said respective threaded bores; and said fastening means includes a pair of screws receivable through said receiving bores for screwing into said threaded bores.

3. A check printer according to claim 1 wherein:

said reel mounting means includes respective reel-receiving bores extending through one ear of each of said pair and an upwardly opening slot in the opposite ear of each of said pair; and said reels are formed on their respective one extremities for telescopical receipt in said respective reel-receiving bores and on their opposite extremities for receipt in said respective slots.

4. A check printer according to claim 1 that includes:

said base is formed with a peripheral upstanding border cut back centrally along the sides thereof to form slots aligned with said print surface for passage therethrough of a check to be printed; and an opaque cover covering said chassis and including side and end walls projecting downwardly toward said base to block viewing of a check on said print surface by an operator.

5. A check printer according to claim 1 wherein:

said base is formed with a horizontally disposed bottom wall and said printer includes:

a check tray disposed below said wheels and including a slider carried on said base for sliding perpendicular to the axes of said wheels; and a check cover covering said tray and cooperating therewith to form a check passage for receipt of a check to be printed and further including a window disposed below said wheels for receipt of the peripheries of said wheels upon depression of said handle.

6. A check printer according to claim 1 wherein:

said base is horizontally disposed and includes a flat bottom wall having a plurality of upstanding guide posts projecting therefrom, at least one of said guide posts being disposed at each end of said base;

said chassis is horizontally disposed and includes a plurality of downwardly opening bosses arranged for telescopical receipt over said posts; and coil compression springs received over said posts and sandwiched between the bottom of said bosses and said base to urge said chassis upwardly away from said base.

7. A check printer according to claim 1 wherein:

said base is formed with a horizontally disposed bottom wall and said printer includes:

a check tray disposed below said wheels and including a slider carried on said base for sliding perpendicular to the axes of said wheels; and a check cover covering said tray and cooperating therewith to form a check passage for receipt of a check to be printed and further including a window disposed below said wheels for receipt of the peripheries of said wheels upon depression of said handle.

* * * * *